US006477924B1

(12) United States Patent
Talbot

(10) Patent No.: US 6,477,924 B1
(45) Date of Patent: Nov. 12, 2002

(54) METHOD FOR RAISING AND LOWERING THE FEED AND DELIVERY TABLES OF A PRINTING PRESS

(76) Inventor: Paul R. Talbot, 62 Kernwood Ave., Beverly, MA (US) 01915

( * ) Notice: Subject to any disclaimer, the term of this patent is extended or adjusted under 35 U.S.C. 154(b) by 0 days.

(21) Appl. No.: 10/007,379

(22) Filed: Nov. 13, 2001

Related U.S. Application Data

(63) Continuation-in-part of application No. 09/645,742, filed on Aug. 24, 2000, now abandoned.

(51) Int. Cl.[7] ..... B25B 13/00
(52) U.S. Cl. ..... 81/124.2; 81/176.15; 81/467
(58) Field of Search ..... 81/124.2, 124.3, 81/121.1, 176.1, 176.15, 176.2, 467, 475; 101/480, 485

(56) References Cited

U.S. PATENT DOCUMENTS 3,086,414 A * 4/1963 Nardi ..... 81/124.2
4,352,614 A * 10/1982 Hirsch ..... 411/402
4,357,845 A * 11/1982 Corina ..... 81/124.2
4,364,440 A * 12/1982 Clar ..... 173/93.7
4,846,025 A * 7/1989 Keller et al. ..... 81/176.1
5,433,850 A * 7/1995 Murray ..... 210/361
6,198,049 B1 * 3/2001 Korinek ..... 174/87

* cited by examiner

*Primary Examiner*—D. S. Meislin
(74) *Attorney, Agent, or Firm*—Ted Masters

(57) ABSTRACT

A method for raising and lowering the feed and delivery tables of a printing press utilizes a drive-limiting tool which is attached to a conventional drill motor. The combination is used to turn the rotatable member of the printing press which in turn through the table's raising and lowering mechanism raises and lowers the feed table. The drive-limiting tool ensures that the table raising and lowering mechanism is not overdriven. It does so by automatically slipping off of the rotatable member of the printing press when the table raising and lowering mechanism reaches its upper and lower limits.

3 Claims, 7 Drawing Sheets

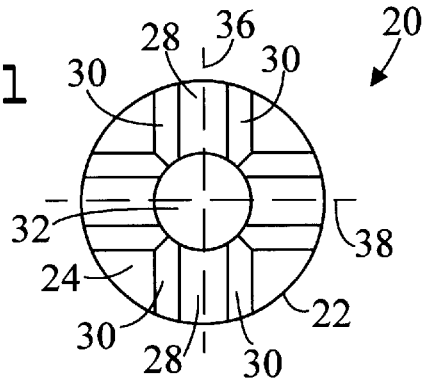
Fig. 1
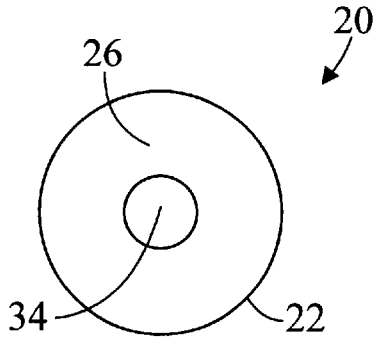
Fig. 3
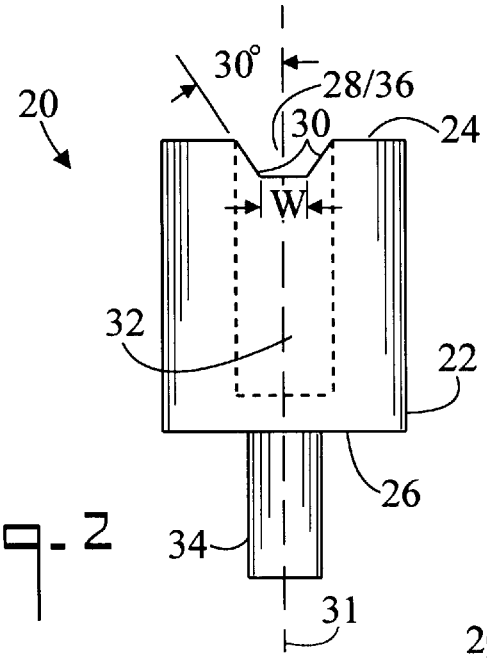
Fig. 2
Fig. 4
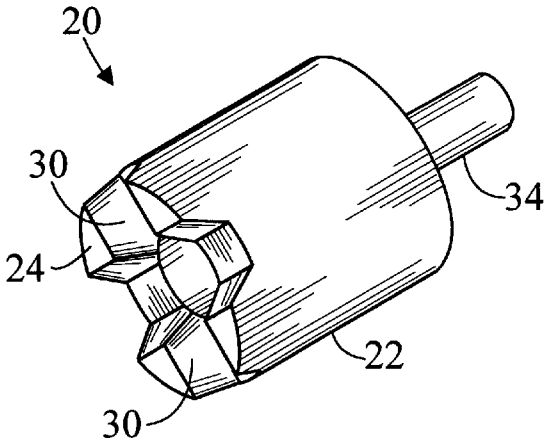

Fig. 13
PRIOR ART
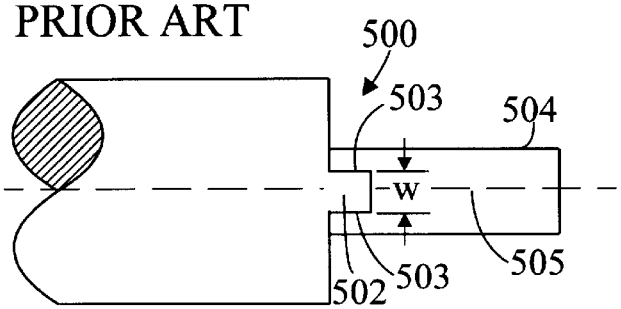
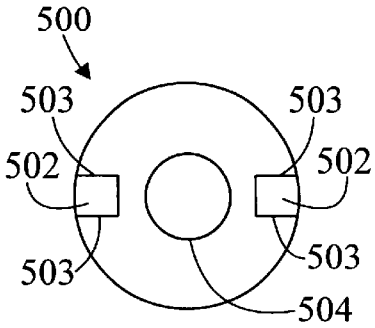
Fig. 14
PRIOR ART
Fig. 15
PRIOR ART
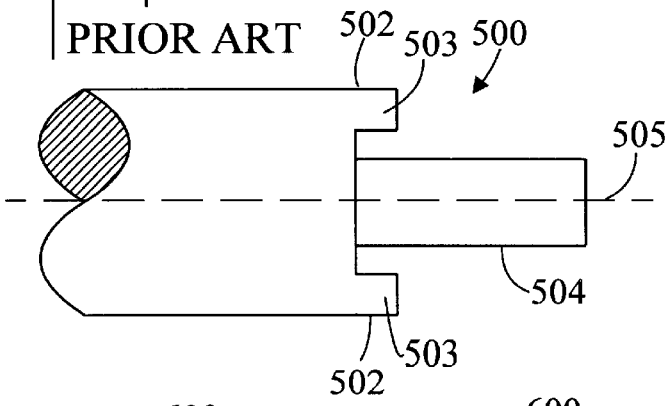
Fig. 17
PRIOR ART
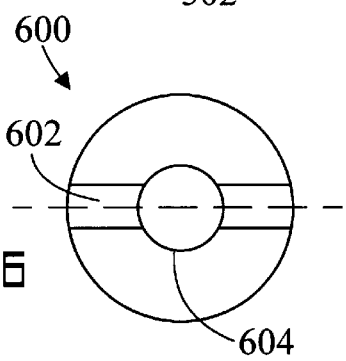
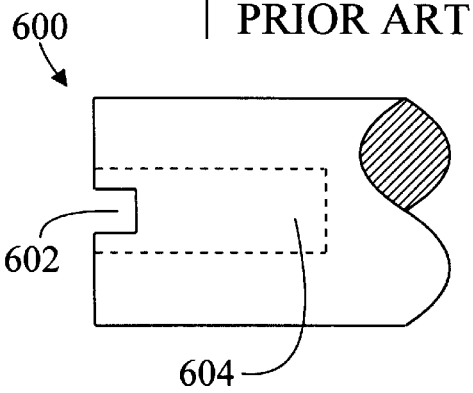
Fig. 16
PRIOR ART Fig. 22
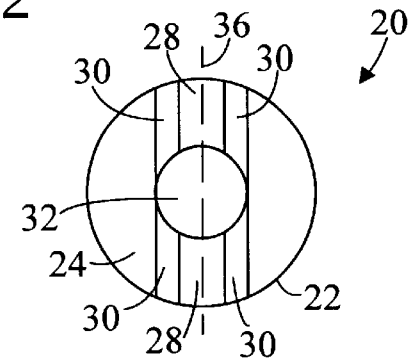
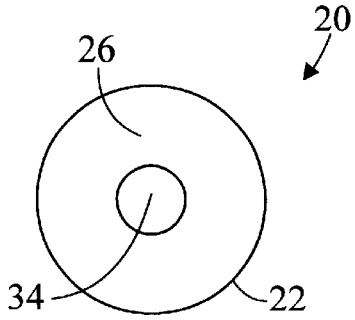
Fig. 24
Fig. 23
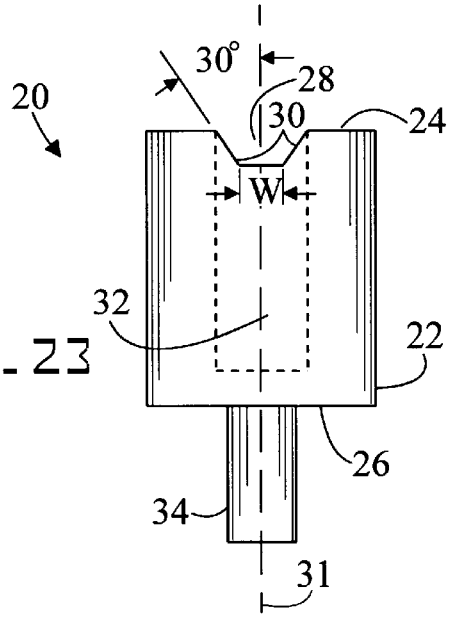
Fig. 25
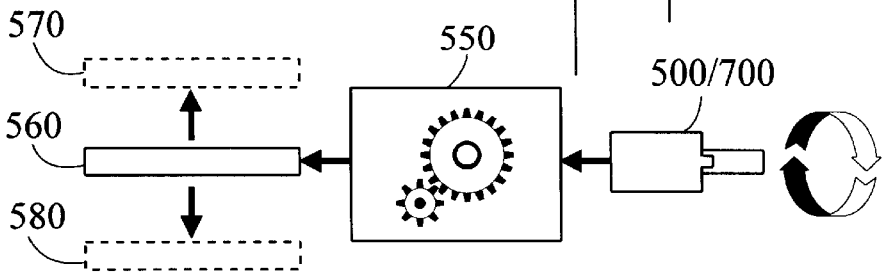

METHOD FOR RAISING AND LOWERING THE FEED AND DELIVERY TABLES OF A PRINTING PRESS

CROSS REFERENCE TO RELATED APPLICATION

This application is a continuation-in-part of application Ser. No. 09/645,742, filed Aug. 24, 2000, now abandoned and which is included herein by reference.

TECHNICAL FIELD

The present invention pertains generally to the printing industry, and more particularly to a method for rapidly raising and lowering the feed and delivery tables of a printing press.

BACKGROUND OF THE INVENTION

When sheets of paper are run through a printing press, the process is known as feeding. When paper is placed into the press the process is known as loading. When paper is placed into the press the paper is placed onto a platform called a feed table. The exact point at which paper is fed into the press to be printed upon by the machine is approximately 3 feet off of the ground. Before paper can be loaded into the press for printing the feed table must be lowered approximately 2.5 feet via means of a chain system operated by a crank handle. To lower the table 2.5 feet the crank must be turned approximately 55 revolutions as quickly as possible to limit non-production time or down time. After a while this can become quite tiresome and repetitive. The act of raising or lowering the feed and delivery tables also requires the operator to be in a bent over posture causing strain on the printing press operator's back.

For example assume that an order was received for 50,000 #10 printed envelopes. #10 envelopes can only be printed 500 at a time. To run this order, 500 unprinted envelopes are placed upon the lowered feed table to be printed. The feed table must then be raised by the crank handle until the top of the stack of envelopes reaches the correct point where the printing press is able to draw the top envelope into the press via an air suction system to be printed. As the envelopes are constantly pulled into the press to be printed the stack is depleted. At these times the press has a device known as a bale bar which moves in an up and down motion, the down motion stops when the bale bar comes in contact with the top of the stack of paper which is constantly depleting due to paper or envelopes being pulled into the printing press to be printed. The feed table is then automatically raised by the press in small increments to keep the upper most sheets of the stack of paper, envelopes etc. in the correct position to be fed into the press for printing. To print on 50,000 envelopes 500 at a time (100 boxes of #10 envelopes) the feed table must be lowered by the hand crank a total of 5,500 revolutions. To use the handle it must be pushed in where two squared cutouts on the inside of the handle intersect with two squared outcroppings on the printing press and held in place. The handle is not permanently attached to the printing press, however it is normally left in position to perform the cranking operation.

Also, where the paper comes out of the printing press, it lands on another table known as the delivery table. This table is very similar to the feed table. The delivery table can be set to go down as the amount of printed sheets accumulate. Once the table reaches the bottom, the printed materials are removed and the table must be re-raised by another hand crank.

Devices for assisting in manual cranking or turning operations are well known in other art fields. For example, U.S. Pat. No. 2,465,048 shows a wrench head for tightening wing nuts which is adapted to be driven by a rotating tool such as a torque screwdriver or the like. The invention tightens wing nuts with improved speed and efficiency.

U.S. Pat. No. 3,086,414 is directed to a combination wrench of the socket type having a cylindrical stem, a free end having an axial bore of a diameter sufficient to provide clearance for the screw to which a nut is to be threaded, and plurality of cut away portions.

U.S. Pat. No. 3,868,874 illustrates an insulative torque coupling assembly for electrical device terminals. The device includes a bolt engaging a bolt passing through an aperture in a terminal of an electrical device. U.S. Pat. No. 4,984,489 defines a window handle turning drive-limiting tool for a hand drill which cooperates with the crank handle of the opening mechanism of a casement window. The drive-limiting tool includes a shaft which is intended to be gripped by the chuck or jaws of the hand drill in much the same manner that hand drills grip drill bits. A forwardly projecting crank handle-contacting head is provided which is adapted to slide over the crank handle.

U.S. Pat. No. 4,846,025 pertains to a tool for removing radiator caps. The tool has a hollow handle and a flanged hollow face. The hollow face has a recess with a perimeter. The perimeter has a pair of opposed rectangular indentations, at least one pair of opposed arcuate indentations, and a pair of tapering indentations which interrupt the perimeter to form a pair of opposed openings.

U.S. Pat. No. 5,433,850 discloses an adapter to operate a honey extractor utilizing a power drill. The adapter engages the drive shaft axially of the honey extractor after removal of the handle which is used for manual operation to connect the drive shaft to a power drill. The adapter is conveniently a socket to engage an end of the drive shaft, the socket having a prong for insertion in the chuck of the power drill.

U.S. Pat. No. 5,697,268 portrays a wing nut driver. The device includes a cylindrical housing having a bore at one end for receiving the wing nut therein.

U.S. Pat. No. 5,896,785 comprises an automobile gas cap removal tool, formed of plastic aluminum having a bell shape with channel formed by the wall segments and a pillar or shaft extending from the top of the bell segment to a handle mounted on the opposite end of the pillar extending from the bell segment.

U.S. Pat. No. 5,996,447 consists of a sink wrench for engaging a faucet mounting nut, the wrench including an elongated tubular pipe which has slots at one end.

SUMMARY OF THE INVENTION

The present invention is directed to a method for using a drive-limiting tool to raise and lower the feed and delivery tables of a printing press. The tool, in combination with a power drill, replaces the manual hand crank which is classically used to raise and lower the tables. The present invention eliminates operator fatigue, increases production, reduces down time, and increases employee moral which comes with the knowledge of not having to crank the feed or delivery table handles any longer. The drive-limiting tool of the present invention is inserted into a common hand held multi-speed reversible phased power drill and firmly secured with a chuck key. The printing press crank handles are removed and the drive-limiting tool is aligned with the rotatable member on the printing press. The feed and delivery tables can then be raised or lowered using the power drill. The speed of the raising or lowering of the feed and delivery tables is increased by a factor of about four depending on the power of the drill. When the tables reach either the top or the bottom in the printing press they come to a halt. The beveled edges allow the drive-limiting tool to "pop out" and not damage the printing press.

Advantages of the Present Invention:

The drive-limiting tool of the present invention replaces the hand cranks on the feed and delivery tables of small offset printing presses.

It can be used alternately on the feed table drive or the delivery table drive on any number of printing presses without installation.

Eliminates operator fatigue, increases production, decreases downtime and increases employee moral which comes with the knowledge of not having to crank the feed or delivery tables any longer.

The drive-limiting tool is constructed of aluminum which is a softer metal than the printing press is constructed of thereby preventing undue wear and tear to valuable printing equipment.

The drive-limiting tool can be used with the feed or delivery drives on numerous types of printing presses without installation and is simple to use. Some types of presses the drive-limiting tool could be used with include the Ryobi 3302M, Ryobi 3200CD, Ryobi 3200NP, Itek 3985, Itek 960, Itek 975 and can be easily redesigned to fit other small printing presses such as Hamada printing presses, Multigraphic printing presses, Heidleberg printing presses and AB Dick printing presses to name a few.

The drive-limiting tool also greatly increases the speed of the raising and lowering of the feed and delivery tables.

In accordance with a preferred embodiment of the invention, a method for raising and lowering a table of a printing press, includes:

(a) providing the printing press having a rotatable member for raising and lowering the feed and delivery tables, the rotatable member having a longitudinal axis, two spaced protuberances having walls disposed substantially parallel to the longitudinal axis of the rotatable member, and a central outwardly projecting shaft, the table having an uppermost position and an opposite lowermost position and a table raising and lowering mechanism, wherein the rotatable member can only raise or lower the table between the uppermost and lowermost positions, and the rotatable member experiencing rotational resistance and ceasing to rotate when the table reaches either of the uppermost or lowermost positions;

(b) providing a drive-limiting tool having:

a front portion;

an opposite rear portion;

a longitudinal axis;

the front portion shaped and dimensioned to engage the rotatable member of the printing press;

the front portion having a slot for receiving the two spaced protuberances;

the front portion having a central hole for receiving the central outwardly projecting shaft;

the slot having two outwardly opening walls which slope outwardly with respect to the longitudinal axis of the drive-limiting tool; and, the rear portion having an axially projecting drive shaft;

(c) providing a power drill;

(d) installing the drive shaft of the drive-limiting tool in the power drill;

(e) engaging the rotatable member with the front portion of the drive-limiting tool;

(f) activating the power drill so that the drive-limiting tool rotates the rotatable member;

(g) continuing to activate the power drill until the table reaches one of the uppermost position and the lowermost position wherein the rotatable member experiences rotational resistance and ceases to rotate; and, (h) when the rotational member ceases to rotate, because of the slope of the walls of the slot, the walls are urged away from the protuberances thereby causing the drive-limiting tool to disengage from the rotatable member, thereby preventing the table raising and lowering mechanism from being overdriven. The disengagement also prevents damage to the power drill, and possible injury to the printing press operator.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a top plan view of a drive-limiting tool for a printing press in accordance with the present invention;

FIG. 2 is a side elevation view of the drive-limiting tool;

FIG. 3 is a bottom plan view;

FIG. 4 is a perspective view of the drive-limiting tool;

FIG. 13 is a fragmented side elevation view of a rotatable member of a printing press;

FIG. 14 is a top plan view of the rotatable member;

FIG. 15 is a fragmented side elevation view of the rotatable member rotated 90° from FIG. 13;

FIG. 16 is a top plan view of a manual rotation shaft;

FIG. 17 is a fragmented side elevation view of the manual rotation shaft;

FIG. 22 is top plan views of another embodiment of the drive-limiting tool;

FIG. 23 is a side elevation view of the embodiment of FIG. 22;

FIG. 24 is a bottom plan view of the embodiment of FIG. 22; and,

FIG. 25 is a functional diagram showing how the printer table is driven.

DETAILED DESCRIPTION OF INVENTION

Figure 5:
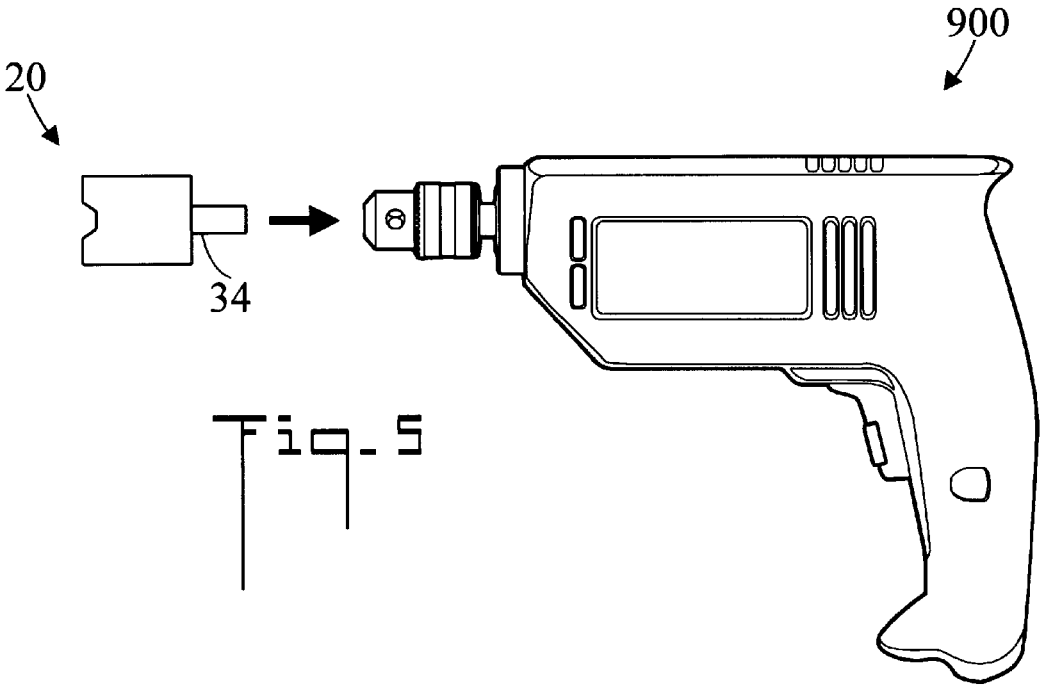
FIG. 5 is a reduced side elevation view of the drive-limiting tool being placed in a power drill.

Referring initially to FIGS. 13–15, there are illustrated fragmented side elevation, top plan, and rotated fragmented side elevation views respectively of a prior art rotatable member of a printing press, generally designated as 500. One rotatable member 500 is mechanically connected to the feed table of the printing press, so that when rotatable member 500 is rotated with a manual rotation shaft 600 (refer to FIGS. 16–17) which is connected to a rotation handle, the feed table may be raised or lowered. The direction of rotation determines whether the feed table is raised or lowered. Another rotatable member 500 is similarly mechanically connected to the delivery table of the printing press. Rotatable member 500 has two spaced protuberances 502, each having a width w. Rotatable member 500 also has a centrally projecting shaft 504.

Referring now to FIGS. 16–17, there are illustrated top plan and fragmented side elevation views respectively of a manual rotation shaft, generally designated as 600. Manual rotation shaft 600 is connected to a rotation handle (not shown). Manual rotation shaft 600 has a slot 602 for receiving two spaced protuberances 502 of rotatable member 500 (refer to FIGS. 13–15). Manual rotation shaft 600 also has a hole 604 for receiving projecting shaft 504 of rotatable member 500. When it is desired to raise or lower the feed or delivery tables of the printing press, manual rotation shaft 600 (and handle) engages rotatable member 500, and rotatable member 500 is rotated to effect the raising or lowering of the table. In normal usage, manual rotation shaft 600 and the handle remain connected to rotatable member 500.

The mechanical configurations shown in FIGS. 13–17 may be found in Multigraphics/Multilith printing presses, and also in Ryobi/Itek and Hamada printing presses.

Figure 18:
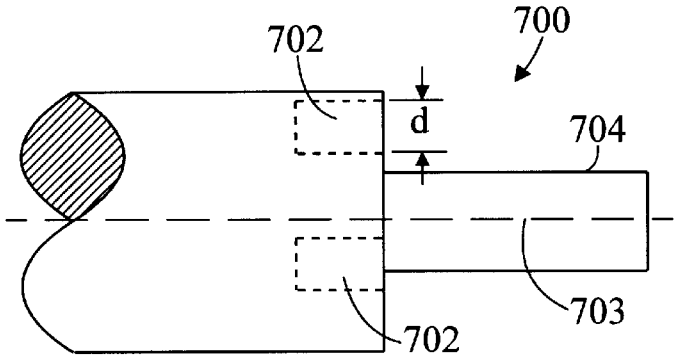
Fig. 18 PRIOR ART
FIG. 18 is a fragmented side elevation view of a second embodiment rotatable member of a printing press.
Figure 19:
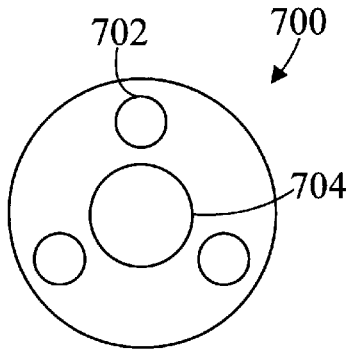
Fig. 19 PRIOR ART
FIG. 19 is a top plan view of the second embodiment rotatable member.

Referring now to FIGS. 18–19, there are illustrated fragmented side elevation and top plan views of a second embodiment prior art rotatable member, generally designated as 700. One rotatable member 700 is mechanically connected to the feed table of the printing press, so that when rotatable member 700 is rotated with a manual rotation shaft 800 (refer to FIGS. 20–21) which is connected to a rotation handle (not shown), the feed table may be raised or lowered. The direction of rotation determines whether the feed table is raised or lowered. Another rotatable member 700 is similarly mechanically connected to the delivery table of the printing press. Rotatable member 700 has three circular holes 702 each having a diameter d. Three holes 702 surround an outwardly projecting shaft 704.

Figure 20:
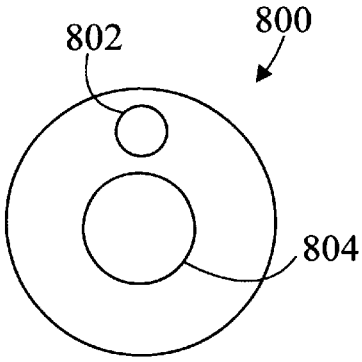
Fig. 20 PRIOR ART
FIG. 20 is a top plan view of a second embodiment manual rotation shaft.
Figure 21:
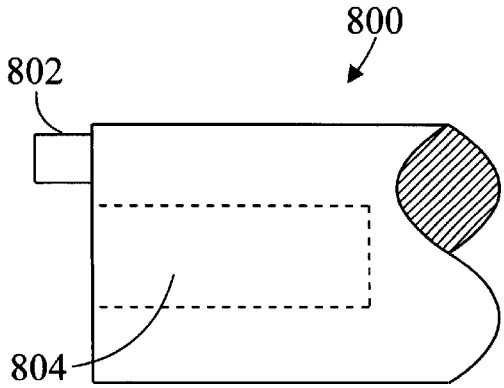
Fig. 21 PRIOR ART
FIG. 21 is a fragmented side elevation view of the second embodiment manual rotation shaft.

Referring now to FIGS. 20–21, there are illustrated top plan and fragmented side elevation views respectively of a second embodiment manual rotation shaft, generally designated as 800. Manual rotation shaft 800 is connected to a rotation handle (not shown). Manual rotation shaft 800 has a protuberance 802 for engaging one of the holes 702 of rotatable member 700 (refer to FIGS. 18–19). Manual rotation shaft 800 also has a hole 804 for receiving projecting shaft 704 of rotatable member 700. When it is desired to raise or lower the feed or delivery tables of the printing press, manual rotation shaft 800 (and handle) engages rotatable member 700, and rotatable member 700 is rotated to effect the raising or lowering of the table. In normal usage, manual rotation shaft 800 and the handle remain connected to rotatable member 700.

The mechanical configurations shown in FIGS. 18–21 may be found in AB Dick 300 & 9800 series printing presses.

Referring now to FIGS. 1–4, there is illustrated top plan, side elevation, bottom plan, and perspective views respectively of a drive-limiting tool for a print press in accordance with the present invention, generally designated as 20. Drive-limiting tool 20 includes a socket-like body 22 having a front portion 24 and an opposite rear portion 26. Front portion 24 has two spaced cavities (or slots) 28 for receiving the spaced protuberances 502 of rotatable member 500 (refer to FIGS. 13–15). Spaced cavities 28 each are defined by two outwardly opening (beveled) walls 30. By having outwardly opening walls 28, drive-limiting tool 20 cannot overdrive rotatable member 500, such as at the top or bottom of the table run. That is, if too much rotational force is exerted upon rotatable member 500, the two spaced protuberances 502 will ride up the slopping walls 30 and disengage drive-limiting tool 20 from rotatable member 500. Front portion also has a central hole 32 for receiving the outwardly projecting shaft 504 of rotatable member 500 (refer to FIGS. 13–15). Rear portion 26 has an axially projecting drive shaft 34 having a longitudinal axis 31. Outwardly opening walls 30 slope outwardly with respect to longitudinal axis 31. In a preferred embodiment two spaced cavities 28 are formed by a first slot (shown by line 36) in said front portion 24. Also in a preferred embodiment, front portion 24 has a second slot (shown by line 38) intersecting first slot 36 at a substantially right angle. By having two substantially perpendicular slots 36 and 38, it is easier to engage spaced protuberances 502 of rotatable member 500. First slot 36 has a bottom portion having a width W which is slightly greater than the width w of the two spaced protuberances 502, so that the two spaced protuberances may be received by first slot 36. In a preferred embodiment, width W of the bottom portion is about 0.25 inches. Also in a preferred embodiment, two outwardly opening walls 30 slop at an angle of about 30° with respect to longitudinal axis 31.

FIG. 5 is a reduced side elevation view of drive-limiting tool 20 being placed in a bi-directional power drill 900. Drive shaft 34 is placed in the chuck of power drill 900 and the chuck tightened.

Figure 6:
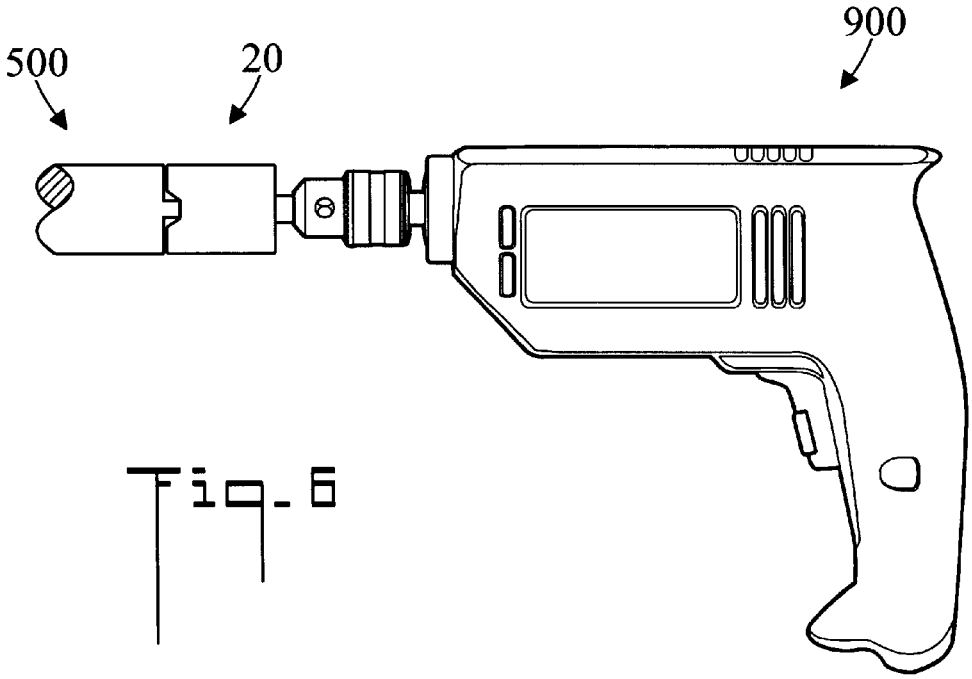
FIG. 6 is a reduced side elevation view of the drive-limiting tool in the power drill engaging a rotatable member of the printing press.
Figure 7:
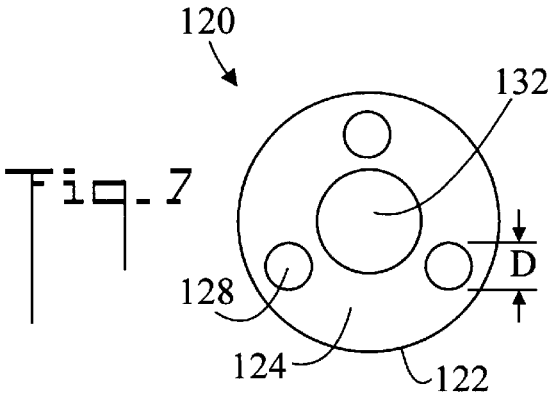
FIG. 7 is a top plan view of a second embodiment of the drive-limiting tool.
Figure 9:
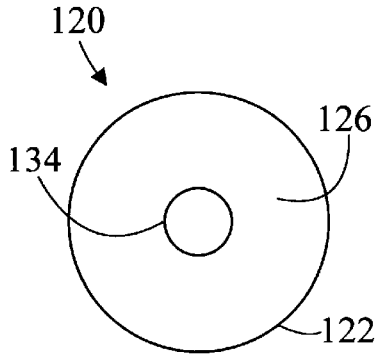
FIG. 9 is a bottom elevation view of the second embodiment drive-limiting tool.
Figure 8:
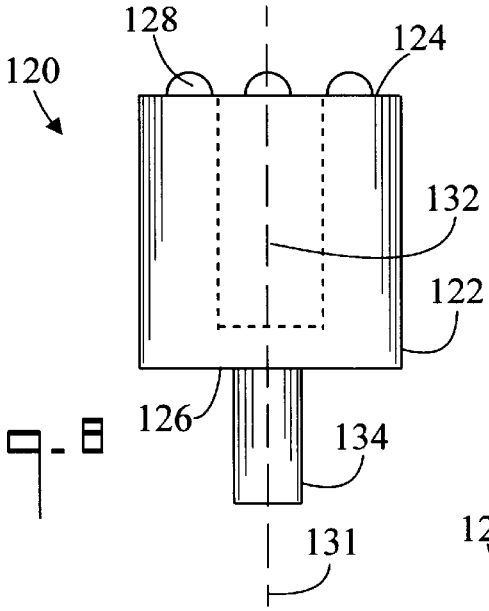
FIG. 8 is a side elevation view of the second embodiment drive-limiting tool.
Figure 10:
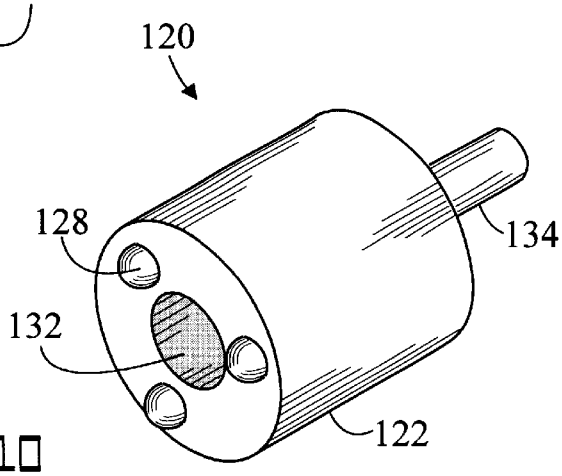
FIG. 10 is a perspective view of the second embodiment drive-limiting tool.

FIG. 6 is a reduced side elevation view of drive-limiting tool 20 installed in power drill 900, and engaging rotatable member 500 of the printing press.

Referring now to FIGS. 7–10, there is illustrated top plan, side elevation, bottom plan, and perspective views respectively a second embodiment of a drive-limiting tool for a printing press in accordance with the present invention, generally designated as 120. Drive-limiting tool 120 includes a socket-like body 122 having a front portion 124 and an opposite rear portion 126. Front portion 124 has three rounded substantially hemispherical protuberances 128 for engaging the three holes 702 in rotatable member 700 (refer to FIGS. 18–19). By having rounded protuberances 128, drive-limiting tool 120 cannot overdrive rotatable member 700, such as at the top of bottom of the table run. That is, if too much rotational force is exerted upon rotatable member 700, the three rounded protuberances 128 will disengage drive-limiting tool 120 from rotatable member 700. Front portion 124 also has a central hole 132 for receiving the outwardly projecting shaft 704 of rotatable member 700 (refer to FIGS. 18–19). Rear portion 126 has an axially projecting drive shaft 134. Three rounded protuberances 128 each have a diameter D which is slightly less than the diameter d of holes 702 in rotatable member 700. In a preferred embodiment, protuberances 128 have a diameter of about 0.25 inches.

Figure 11:
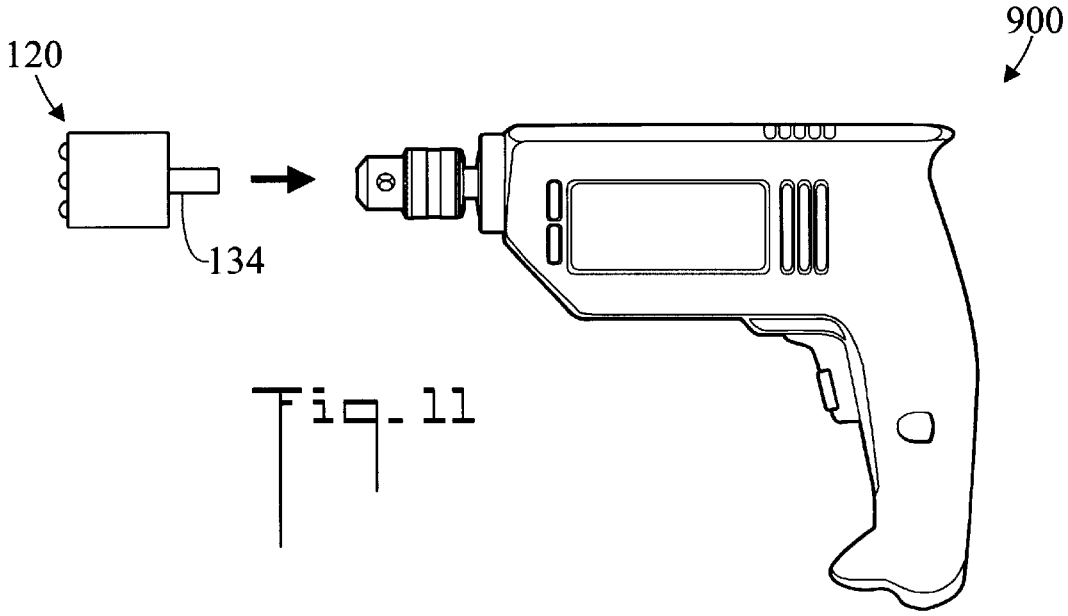
FIG. 11 is a reduced side elevation view of the second embodiment drive-limiting tool being placed in a power drill.

FIG. 11 is a reduced side elevation view of the second embodiment drive-limiting tool 120 being placed in a bidirectional power drill 900.

Figure 12:
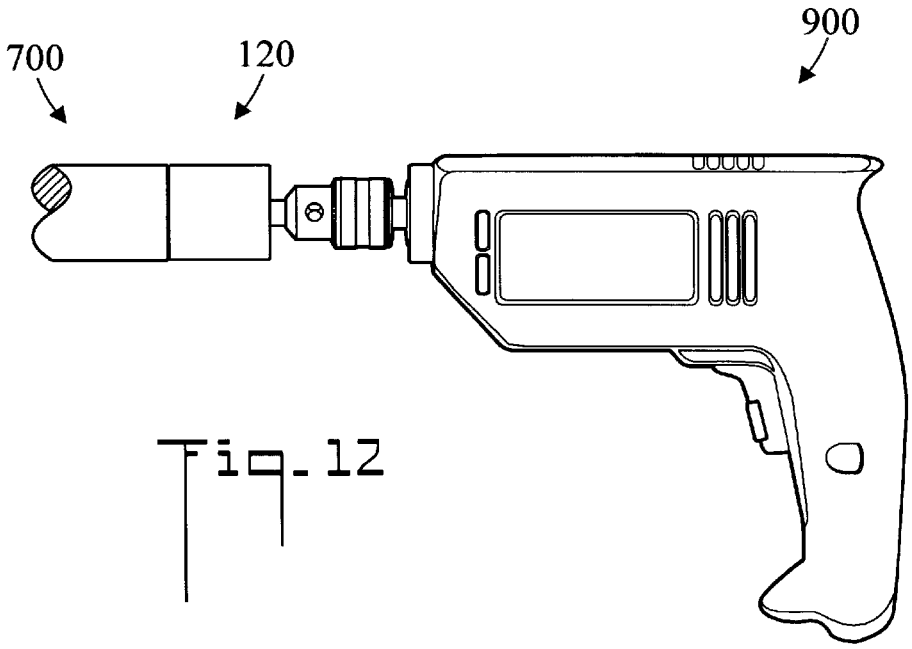
FIG. 12 is a reduced side elevation view of the second embodiment drive-limiting tool in the power drill engaging the rotatable member of the printing press.

FIG. 12 is a reduced side elevation view of the second embodiment drive-limiting tool 120 installed in the power drill 900, and engaging the rotatable member 700 of the printing press.

FIGS. 22–24 are top plan, side elevation, and bottom plan views respectively of another embodiment of drive-limiting tool 20. This embodiment is similar to the embodiment of FIGS. 1–4 with the exception that in this embodiment drive-limiting tool 20 only has one cavity or slot 28 for engaging rotatable member 500.

FIG. 25 is a functional diagram showing how the printer table is driven. Rotatable members 500/700 drive table raising and lowering mechanism 550, which in turn raises or lowers feed or delivery table 560 between uppermost position 570 and lowermost position 580.

In a preferred embodiment, the drive-limiting tool is fabricated from aluminum or some other suitable metal. A polymer could also be utilized.

In terms of use, a method for raising and lowering a feed or delivery table of a printing press includes the steps of (refer also to FIGS. 1–6, and 13–25 as described above);

(a) Providing a printing press having rotatable members 500 connected to both its feed and delivery tables 560, the rotatable member 500 for raising and lowering the respective tables 560, said rotatable member 500 having a longitudinal axis 505, two spaced protuberances 502 having walls 503 disposed substantially parallel to longitudinal axis 505 of rotatable member 500, and a central outwardly projecting shaft 504, table (feed or delivery) 560 having an uppermost position 570 and an opposite lowermost position 580, wherein rotatable member 500 can only raise or lower the table 560 between the uppermost 570 and the lowermost 580 positions. That is, as rotatable member 500 is turned the table 560 moves according to the direction of rotation until either the uppermost 570 or lowermost 580 position is reached. At either of these extreme positions, the table raising and lowering mechanism 550 reaches its limit and can move no more, therefore rotatable member 500 experiences rotational resistance and ceases to rotate (i.e. cannot be rotated further). Continued attempts to forcibly rotate rotatable member 500 can overdrive and consequently damage the table's raising and lowering mechanism 550.

(b) Providing a drive-limiting tool 20. Drive-limiting tool 20 having a front portion 24, an opposite rear portion 26, and a longitudinal axis 31. Front portion 24 is shaped and dimensioned to engage rotatable member 500 of the printing press. Front portion 24 has a slot 28 for receiving the two spaced protuberances 502 of rotatable member 500. Front portion 26 has a central hole 32 for receiving the central outwardly projecting shaft 504 of rotatable member 500. Slot 28 has two outwardly opening walls 30 which slope outwardly with respect to longitudinal axis 31 of drive-limiting tool 20. Rear portion 26 has an axially projecting drive shaft 34.

(c) Providing a power drill 900. In a preferred embodiment, power drill 900 is reversible.

(d) Installing drive shaft 34 of drive-limiting tool 20 in power drill 900.

(e) Engaging rotatable member 500 with front portion 26 of drive-limiting tool 20. That is, placing the two spaced protuberances 502 in slot 28, and outwardly projecting shaft 504 into central hole 32.

(f) Activating power drill 900 so that drive-limiting tool 20 rotates rotatable member 500.

(g) Continuing to activate power drill 900 until table 560 reaches one of the uppermost position 570 and lowermost position 580 wherein rotatable member 500 experiences rotational resistance and ceases to rotate. That is, rotating rotatable member 500 until table raising and lowering mechanism 550 reaches its uppermost or lowermost limit.

(h) When rotational member 500 ceases to rotate, because of the slope of the walls 30 of slot 28, walls 30 are urged away from protuberances 502 thereby causing drive-limiting tool 20 to disengage from rotatable member 500, thereby preventing the table raising and lowering mechanism 550 from being overdriven. In other words, as table raising and lowering mechanism 550 reaches its limit, rotatable member 500 ceases to freely rotate, and because of the slope in the walls 30 of slot 28, slot 28 rides up protuberances 502 and ultimately disengages drive-limiting tool 20 from rotatable member 500. In a preferred embodiment of the present invention, walls 30 of slot 28 slope outwardly about 30° from longitudinal axis 31 of drive-limiting tool 20. This angle provides a useful compromise between (1) a lesser angle which would tend to cause drive-limiting tool 20 to remain in contact with rotatable member 500 too long and therefore risk overdriving table raising and lowering mechanism 550, and (2) a greater angle which would tend to cause drive-limiting tool 20 to unwantingly slip off of rotatable member 500 during the raising and lowering process.

Another very similar method for raising and lowering a feed or delivery table of a printing press includes the steps of (refer also to FIGS. 7–25 as described above);

(a) Providing a printing press having rotatable members 700 connected to both its feed and delivery tables 560, the rotatable member 700 for raising and lowering the respective tables 560, the rotatable member 700 having a longitudinal axis 703, three circular holes 702 disposed parallel to longitudinal axis 703, and a central outwardly projecting shaft 704, table (feed or delivery) 560 having an uppermost position 570 and an opposite lowermost position 580, wherein rotatable member 500 can only raise or lower the table 560 between the uppermost 570 and the lowermost 580 positions. That is, as rotatable member 700 is turned the table 560 moves according to the direction of rotation until either the uppermost 570 or lowermost 580 position is reached. At either of these extreme positions, the table raising and lowering mechanism 550 reaches its limit and can move no more, therefore rotatable member 700 experiences rotational resistance and ceases to rotate (i.e. cannot be rotated further). Continued attempts to forcibly rotate rotatable member 700 can overdrive and consequently damage the table's raising and lowering mechanism 550.

(b) Providing a drive-limiting tool 120. Drive-limiting tool 120 having a front portion 124, an opposite rear portion 126, and a longitudinal axis 131. Front portion 124 is shaped and dimensioned to engage rotatable member 700 of the printing press. Front portion 124 has three rounded protuberances 128 for engaging the three holes 702 in rotatable member 700. Front portion 124 has a central hole 132 for receiving the central outwardly projecting shaft 704 of rotatable member 700. Rear portion 126 has an axially projecting drive shaft 134.

(c) Providing a power drill 900. In a preferred embodiment, power drill 900 is reversible.

(d) Installing drive shaft 134 of drive-limiting tool 120 in power drill 900.

(e) Engaging rotatable member 700 with front portion 124 of drive-limiting tool 120. That is, placing the three rounded protuberances 128 in the three holes 702, and outwardly projecting shaft 704 into central hole 132.

(f) Activating power drill 900 so that drive-limiting tool 120 rotates rotatable member 700.

(g) Continuing to activate power drill 900 until table 560 reaches one of the uppermost position 570 and lowermost position 580 wherein rotatable member 700 experiences rotational resistance and ceases to rotate. That is, rotating rotatable member 700 until table raising and lowering mechanism 550 reaches its uppermost or lowermost limit.

(h) When rotatable member 700 ceases to rotate, because of the three rounded protuberances 128, the three rounded protuberances 128 are urged out of the three holes 702 thereby causing drive-limiting tool 120 to disengage from rotatable member 700, thereby preventing table raising and lowering mechanism 550 from being overdriven. In other words, as table raising and lowering mechanism 550 reaches its limit, rotatable member 700 ceases to freely rotate, three rounded protuberances ride up and out of three holes 702 and ultimately disengage drive-limiting tool 120 from rotatable member 700. In a preferred embodiment of the present invention, three rounded protuberances 128 are substantially dome-shaped.

Testing Results—The present invention has been extensively tested, has surpassed all expectations. Hand cranks are no longer necessary for raising or lowering the feed or delivery tables. Where it used to take approximately 30 seconds to lower the feed table cranking the hand crank as fast as possible, it now takes less than 5 seconds and requires virtually no effort. The drive-limiting tool of the present invention has completely eliminated the most wearisome task associated with the operation of small offset printing presses. It has also increased production, reduced downtime, safeguards printing press operators physical well being and boosts a printing press operator's moral.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for raising and lowering a table of a printing press, comprising:

(a) providing said printing press having a rotatable member for raising and lowering said table, said rotatable member having a longitudinal axis, two spaced protuberances having walls disposed substantially parallel to said longitudinal axis of said rotatable member, and a central outwardly projecting shaft, said table having an uppermost position and an opposite lowermost position and a table raising and lowering mechanism, wherein said rotatable member can only raise or lower said table between said uppermost and said lowermost positions, and said rotatable member experiencing rotational resistance and ceasing to rotate when said table reaches either of said uppermost or lowermost positions;

(b) providing a drive-limiting tool having:

a front portion;

an opposite rear portion;

a longitudinal axis;

said front portion shaped and dimensioned to engage said rotatable member of said printing press;

said front portion having a slot for receiving said two spaced protuberances;

said front portion having a central hole for receiving said central outwardly projecting shaft;

said slot having two outwardly opening walls which slope outwardly with respect to said longitudinal axis of said drive-limiting tool; and, said rear portion having an axially projecting drive shaft;

(c) providing a power drill;

(d) installing said drive shaft of said drive-limiting tool in said power drill;

(e) engaging said rotatable member with said front portion of said drive-limiting tool;

(f) activating said power drill so that said drive-limiting tool rotates said rotatable member;

(g) continuing to activate said power drill until said table reaches one of said uppermost position and said lowermost position wherein said rotatable member experiences rotational resistance and ceases to rotate; and, (h) when said rotational member ceases to rotate, because of said slope of said walls of said slot, said walls urged away from said protuberances thereby causing said drive-limiting tool to disengage from said rotatable member, thereby preventing said table raising and lowering mechanism from being overdriven.

2. The method according to claim 1, wherein said table is one of a feed table and a delivery table.

3. The method according to claim 1, further including:

said walls of said slot sloping outwardly about 30° from said longitudinal axis of said drive-limiting tool.

* * * * *